United States Patent [19]

Amoroso

[11] 4,294,317

[45] Oct. 13, 1981

[54] DRILLHEAD UNIT

[75] Inventor: Michael J. Amoroso, Marion, Ill.

[73] Assignee: M.A.T. Industries, Inc., West Frankford, Ill.

[21] Appl. No.: 951,747

[22] Filed: Oct. 16, 1978

[51] Int. Cl.[3] ..... E21C 7/02

[52] U.S. Cl. ..... 173/57; 277/85

[58] Field of Search ..... 173/38, 78, 79, 57; 277/85

[56] References Cited

U.S. PATENT DOCUMENTS

| | | | |
|---|---|---|---|
| 2,702,203 | 2/1955 | Sefren et al. | 277/85 |
| 2,730,330 | 1/1956 | Ball | 173/38 |
| 3,252,525 | 5/1966 | Pyles | 173/38 X |
| 3,447,810 | 6/1969 | Porter | 277/85 |
| 3,508,767 | 4/1970 | Crist et al. | 277/85 X |
| 3,990,522 | 11/1976 | Pyles et al. | 173/78 |
| 4,190,116 | 2/1980 | O'Neal et al. | 173/38 |

*Primary Examiner*—Wm. Carter Reynolds

*Attorney, Agent, or Firm*—Cohn, Powell & Hind

[57] ABSTRACT

This drillhead unit includes a sealed housing mounting a bevel gear assembly and a bevel drive pinion assembly. The bevel gear assembly includes a hollow shaft providing a chuck for receiving a hollow drill bit and the bevel pinion assembly includes a shaft providing a connection for a hydraulic drive motor. The hollow shaft is connected to a cavity within the housing, which is connected to exhaust passages connected to a vacuum source. A vacuum sealing assembly is provided within the housing between the bevel gear assembly and the housing to eliminate bearing lubrication loss. The unit can also be used for reverse flow positive water pressure in lieu of a vacuum.

7 Claims, 5 Drawing Figures

DRILLHEAD UNIT

BACKGROUND OF THE INVENTION

This invention relates generally to drillhead units and particularly to a drillhead unit used in conjunction with a hollow drill bit to provide holes for the insertion of roof bolts in coal mines.

There are several problems connected with the drilling of holes in coal mine roofs for the insertion of roof bolts, particularly when drillhead units are used of the type which rely on a vacuum pulled through a hollow drill bit.

One of these problems is the relatively short life of the drillhead unit resulting from the fact that the vacuum used to remove cuttings from the hollow drill bit tends to suck the lubricant out of the unit which results in failure of the bearings and pinions.

Another problem is that when the hydraulic motors, which are used to drive the pinions, are changed due to malfunction dirt enters the drillhead unit and can cause premature failure. In general, drillhead units provide a beveled pinion mounted to the motor shaft, and when the motor is inserted into the pinion housing it automatically positions the pinion. This arrangement tends to lead to sealing problems and, in addition, in some cases, only the tips of the cooperating pinions in the drillhead are engaged due to an improperly located motor pinion and this can also result in wear and premature failure.

Still another problem is that the chuck depth for the hollow drill bit must be sufficient to provide a secure connection for the drill bit, so that it cannot be thrown out of the chuck during rotation, and this can result in the chuck extending a substantial distance above the drillhead unit.

Yet another problem with known drillhead units resides in the fact that the top surface of the housing is normally covered with dirt which migrates into the top seals because of inadequate sealing of the gear assembly of the unit operating in powdered coal and rock which is very destructive to the mechanism.

This drillhead unit solves the above and other problems in a manner not disclosed in the known prior art.

SUMMARY OF THE INVENTION

This drillhead unit is provided with a seal assembly between the bit-receiving gear assembly and the housing interior which virtually eliminates loss of bearing lubrication resulting from the application of a vacuum to the drill bit through the interior of the housing.

A drive pinion assembly is provided which is accurately mounted within the housing rather than to the end of the drive motor shaft so that the motor shaft can be removed without loss of lubrication and admission of dirt. The drive pinion assembly is mounted independently of the motor so that it need not be disturbed when the motor is replaced and a more effective seal is achieved.

The structural arrangement of the drill bit gear assembly shaft provides a deep chuck passage extending into the interior of the housing which tends to hold the drill bit in place and reduce the possibility of the bit being thrown out from the chuck during rotation.

A dust cover and seal assembly is provided between the housing and the drillhead gear assembly to protect the upper portion of the housing from the ingress of dust and dirt from the mine roof and into contact with the gear assembly.

The housing is provided with dual vacuum exhaust passages so that one drillhead unit will accommodate either position on a twin bolter unit and eliminate the need for providing left and right hand drillhead units.

This drillhead unit includes a housing having an inner passage portion. A gear assembly is received by the housing having a longitudinal axis of rotation and including a shaft, said shaft having an outer bit-receiving end, an inner end remote from said outer end, and an axial passage extending between said inner and outer ends and connected to the inner passage portion of the housing, said assembly also including a gear disposed between the inner and outer ends of the shaft and being connected to said shaft for rotation therewith.

Mounting means are provided for the gear assembly including bearing means disposed in coaxial relation between the gear assembly and the housing and pressure sealing means is disposed between the gear assembly and housing for separating the bearing means for the inner passage portion of the housing.

A drive pinion assembly is received by the housing having an axis of rotation disposed transversely of the axis of rotation of the gear assembly and including a shaft, said shaft having an outer end connected to the motor and an inner end remote from said outer end, said assembly also including a pinion disposed at the inner end of the shaft and connected to said shaft for rotation therewith, said pinion being drive engageable with the gear assembly.

Mounting means are provided for the drive pinion assembly including bearing means disposed between the pinion assembly and the housing. The bearings of the pinion assemblies include spaced inner and outer taper bearings having radial and thrust bearing capability.

The gear assembly shaft inner end includes an annular recess having a transverse bearing face and spaced cylindrical walls and the pressure sealing means includes a coaxial cylindrical element attached to the base and having a transverse bearing face, said element being spaced from said recess walls and transverse bearing face, and a resilient combination seal mounted between said recess walls and said cylindrical element.

The pressure sealing means includes an annular metallic ring having opposed bearing faces, one of which is engageable in bearing relation with said recess bearing face; a spring mounted to said cylindrical element and engageable with said cylindrical transverse bearing face; an annular friction seal having opposed bearing faces one of which is engageable in bearing relation with the spring and is urged away from the cylindrical transverse bearing face; and a carbon ring disposed between the annular seal and the other face of the annular ring in sliding relation to said other face. The pressure sealing means also includes an O-ring means disposed between the annular ring and one of said cylindrical recess walls in frictional relation with said parts to provide that they rotate together; and an O-ring means between said cylindrical element and the other of said recess walls to seal said parts.

The housing includes a base and a removable cover for the second pinion assembly carrying at least part of the drive pinion assembly and shim means are provided between the cover and the base for axial adjustment of said cover relative to said base to locate the drive pinion relative to the axis of the gear assembly The drive pinion assembly shaft includes a threaded end and the mounting means for the drive pinion assembly includes a collar threadedly received by the thread end and the bearing means cooperate with the collar to hold the pinion assembly to said cover.

The housing also includes a removable cover for the gear assembly carrying at least part of said assembly and shim means is provided between the base and the cover for axial adjustment of the cover relative to the base to locate the gear relative to the axis of the pinion assembly.

The gear assembly shaft includes an outer portion, extending both outwardly and inwardly of the cover, an inner portion disposed entirely within the housing and a thrust plate disposed between said inner and outer portions, said thrust plate being engageable by the drill bit.

The drive pinion assembly shaft is recessed to receive the motor shaft and sealing means is provided between said collar and said removable cover.

The gear assembly includes a dust cover rotatable with the gear assembly shaft.

The housing inner passage portion includes a cavity connecting the shaft passage to a pair of transversely extending exhaust passages disposed within the housing and connected to the pressure source which is a vacuum.

The drillhead unit is adapted for use with reverse flow positive pressure water in lieu of a vacuum source.

DESCRIPTION OF THE PREFERRED EMBODIMENT

Figure 1:
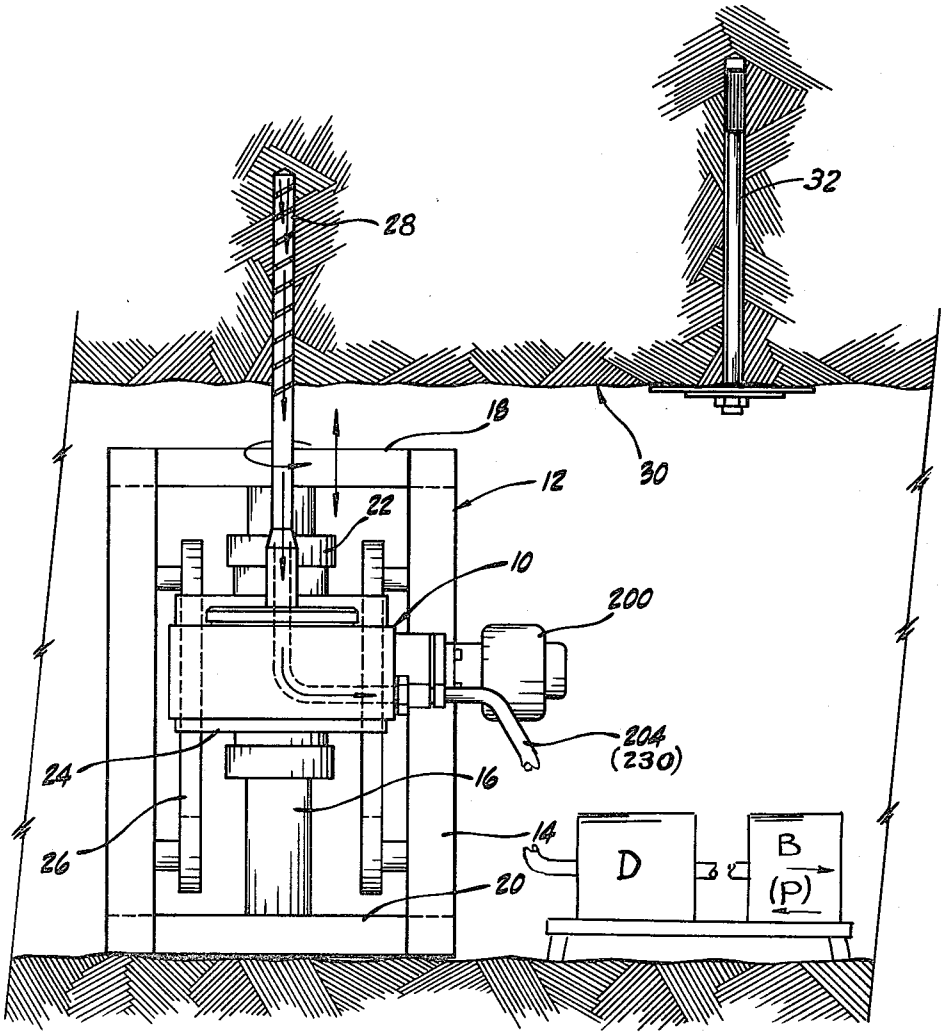
FIG. 1 is a view of the drillhead unit used in conjunction with a roof bolter.

Referring now by reference numerals to the drawings and first to FIG. 1, it will be understood that the drillhead unit generally indicated by numeral 10 is used in conjunction with a roof bolter unit 12 and is shown operatively mounted to said unit. The roof bolter 12 includes a frame 14 having a mast 16 extending between upper and lower frame members 18 and 10, respectively, which provides a guide for a vertically movable carriage member 22 having a mounting plate 24 to which the drillhead unit 10 is operatively attached. The mounting blade 24, and therefore the drillhead unit 10, is raised and lowered toward and away from the roof 30 by means of a chain drive system generally indicated by numeral 26. Power is supplied to the unit 10 by a motor 20.

The drillhead unit 10 is used to rotate a hollow drill bit generally indicated by numeral 28, which drills vertical holes in the mine roof 30 preparatory to the insertion of an anchored roof bolt such as that generally indicated by numeral 32. The hollow drill bit 28 receives the drill cuttings which are drawn through the drillhead unit 10 by a vacuum which is applied to said unit through a vacuum hose 204 by a vacuum source such as a blower B by way of a dust collector D, as shown in FIG. 1, at a pressure of between 15–20 inches of mercury.

Figure 2:
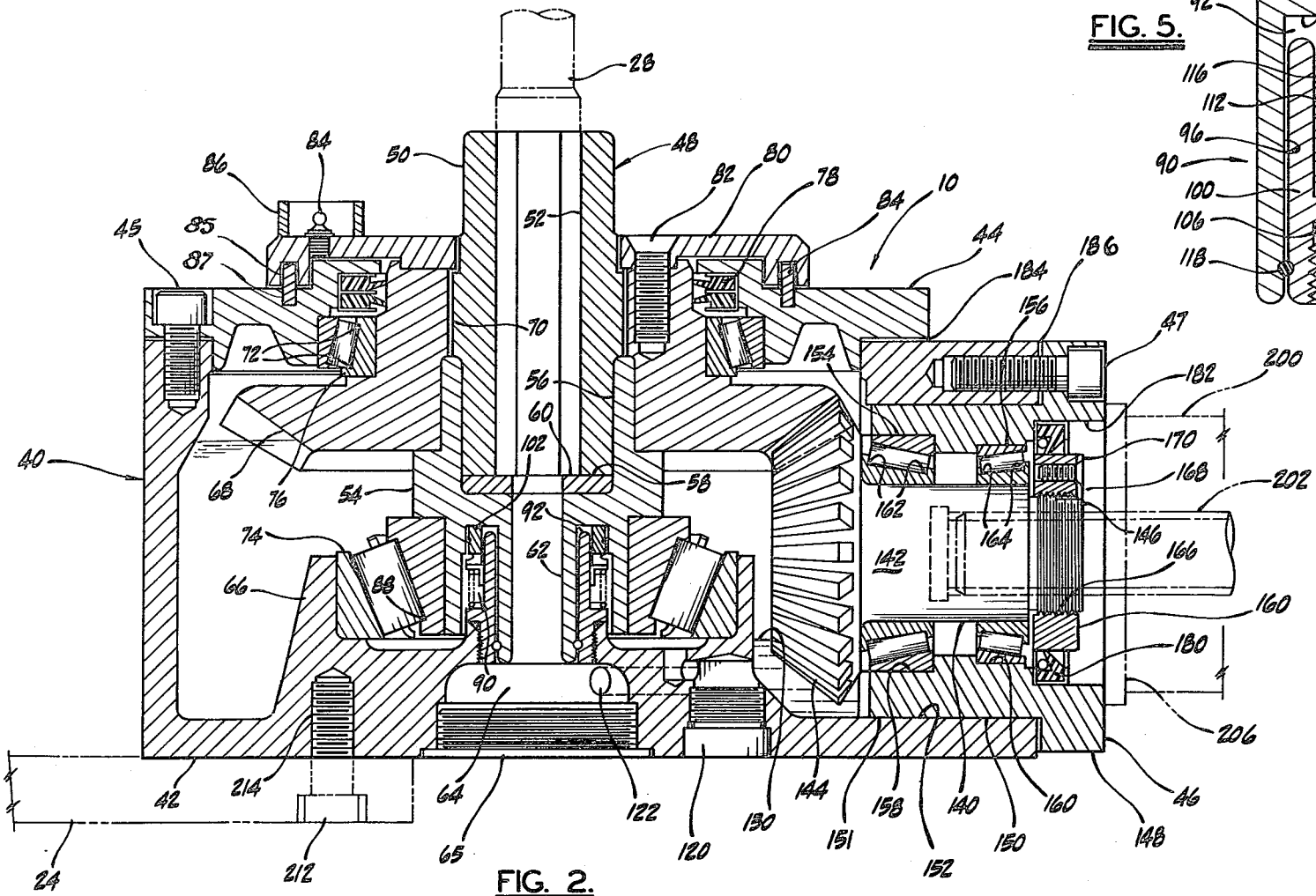
FIG. 2 is a cross-sectional view through the drillhead unit.

The drillhead unit 10 will now be described with particular reference to FIGS. 2 through 5. As shown in FIG. 2, the drillhead unit 10 includes a housing having a base 42, an upper cover plate 44 removably connected to the base 42 as by fasteners 45 and a side cover plate 46 removably connected to the base 412 as by fasteners 47.

The cover plate 44 is apertured to receive a gear assembly generally indicated by numeral 48, which includes an outer bit-receiving shaft end portion 50 having a deep interior passage 52 adapted to receive the end of the hollow bit 28, and a shaft inner end portion 54 having an enlarged coaxial passage portion 56 receiving the outer portion 50, said shaft portions constituting a shaft. The passage 56 includes an end wall 58 providing an abutment for a thrust plate 60 disposed between the upper and lower shaft portions. The inner shaft portion 54 also includes a reduced passage 62 extending between the passage 52 at one end and communicating at the other end with a cavity 64 provided in a hub-like seating portion 66 of the housing base 42, said cavity being provided with a sealed removable clean-out plug 65. The cavity 64 receives cuttings from the drill bit 28 via passages 52 and 62 and communicates with a vacuum source as will be discussed below. A gear 68 is mounted to the shaft upper and lower portions 50 and 54 by means of splines 70 so that said shaft portions rotate with said gear 68. The gear assembly 48 is rotatively mounted to the housing 40 by tapered roller cone bearings 72 and 74. Bearing 72 is disposed between the gear 68 and the housing cover plate 44 and includes shoulders 76 which provide the bearing with both radial and thrust bearing capability. A seal ring 78 of rubber or similar material is disposed in sealing relation between the stationary cover plate 44 and the rotating gear 68. The gear assembly 48 also includes a dust cover 80 which is attached to said gear as by fasteners 82 for rotation with said gear, a teflon ring 84 being provided between the relatively movable dust cover 80 and the stationary housing cover plate 44, said dust cover and said cover plate being suitably grooved at 85 and 87 to receive said ring in spaced and fitted relation respectively. The dust cover 80 is provided with a grease fitting 84, having a protective shroud 86, and supplying grease to the labyrinth between seals 78 and 84 including groove 85.

Figure 5:
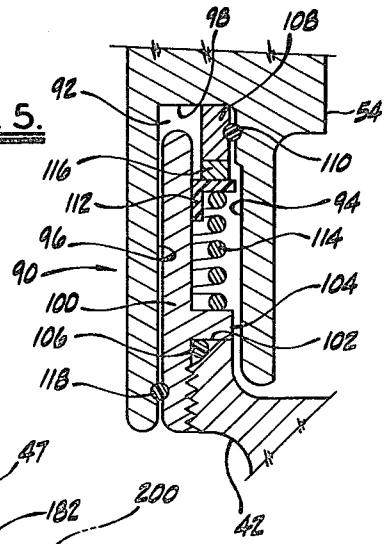
FIG. 5 is an enlarged view of the pressure sealing assembly.

The inner roller bearing 74 also includes shoulders 88 which provide the bearing with radial and thrust bearing capability. A face seal assembly is provided between the inner shaft portion 54 and the housing base 42, generally indicated by numeral 90 which constitutes a pressure sealing means and is best understood by reference to FIG. 5. As shown in FIG. 5, the inner shaft portion 54 includes a deep annular socket 92 having oppositely disposed generally cylindrical sidewalls 94 and 96 and endwall 98 which receives the seal assembly 90, which provides a resilient combination seal.

Figure 3:
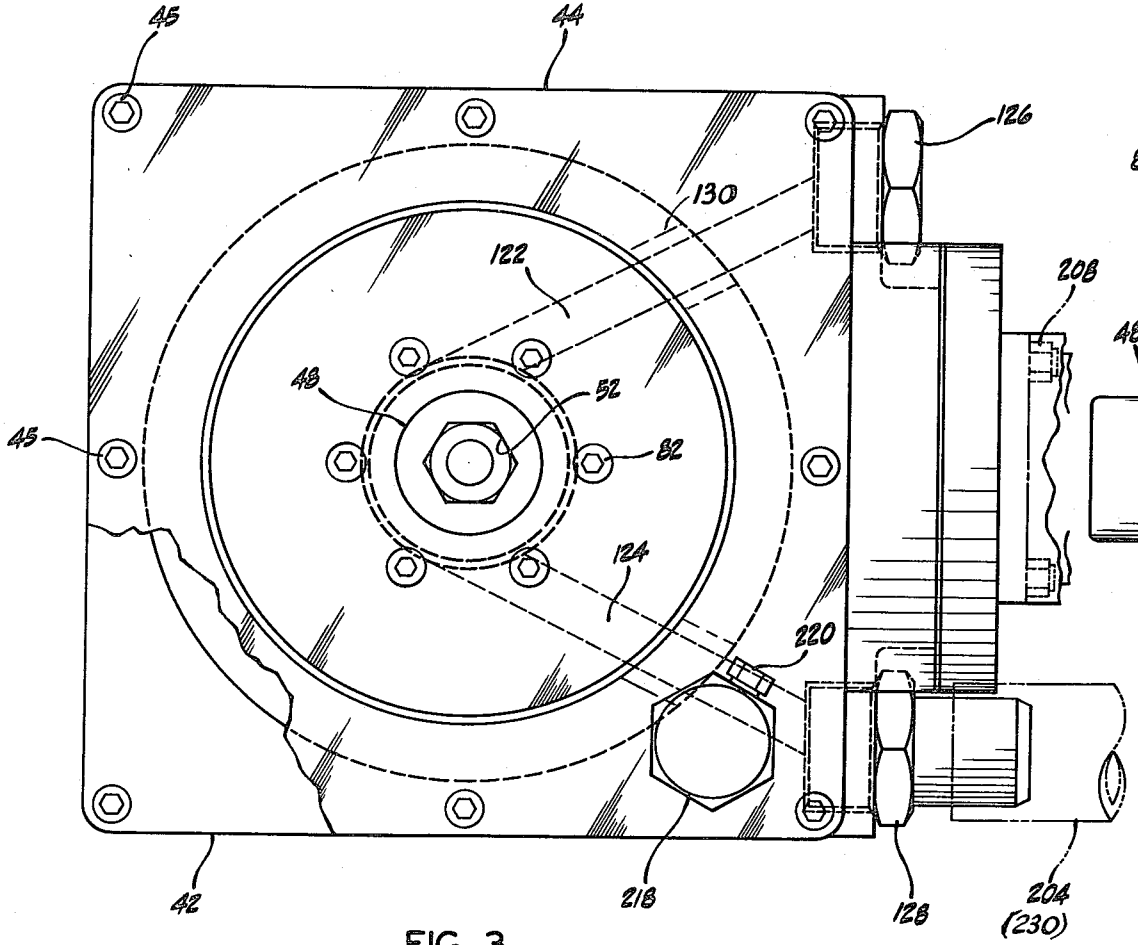
FIG. 3 is a plan view thereof.

The seal assembly 90, which is capable of resisting positive or negative pressure and is used as a vacuum seal in the embodiment described, includes a cylindrical element 100 which is threadedly engageable with an annular rim 102 formed on the seating portion 66 of the housing base 42. The cylindrical element 100 includes an annular ledge 104, and an O-ring seal 106 is disposed between said ledge 104 and said rim 102. This seal assembly 90 also includes a stainless steel ring 108 which rotates with the shaft 54. This stainless steel ring 108 is engageable with the socket endwall 98, which constitutes a transverse bearing face, and an O-ring seal 110 is disposed between said ring 108 and said cylinder wall 94 and provides sufficient friction to ensure that said ring 108 and said shaft 54 rotate together. A resiliently mounted seal 112 of rubber or the like is mounted to the cylindrical element 100 and is urged outwardly by means of a compression spring 114 extending between said ring and the annular ledge 104, said ledge providing a transverse bearing fall for said spring. A carbon ring 116 is disposed between the seal 112 and the stainless steel ring 108 and, by virtue of the friction between the rubber seal 112 and the carbon ring 116, the latter is maintained in a substantially stationary condition to provide a bearing face for the relatively smooth rotating stainless steel ring 108. An O-ring 118 is disposed between the cylindrical element 94 and the socket wall 96. The drillhead housing is supplied with lubricant by means of an oil fill plug 218 and the seal assembly 90, by virtue of the cooperation between the O-rings 110 and 118 together with the seal 114 and O-ring 106, provides an effective seal which prevents the escape of lubricant into the cavity 64 when a vacuum is applied to said cavity. The vacuum is applied to the housing cavity 64, the shaft passages 62 and 52 and the bit 28 by the blower vacuum source B through the medium of one of two exhaust passages 122 and 124 connected to said vacuum source and said cavity 64. As shown in FIG. 3, two exhaust passages are provided so that the drillhead unit 10 can be used in alternative positions in conjunction with a twin head bolting unit thereby obviating the need for left and right hand drillhead units. In the embodiment shown the exhaust passage 124 is connected to the vacuum source by way of fitting 128 and hose 204, and a closure plug fitting 126 is provided for exhaust passage 122. It will be understood that the exhaust passages are formed, as by boring, in a thickened portion of the housing base 42 extending between the cavity 64 and the fittings 126 and 128, and indicated by numeral 130. It will also be understood that said cavity and exhaust passages cooperate to define a housing inner passage portion connecting the vacuum hose 204 to the shaft passage 62 and the hollow drill bit 28 and separated from the outer portion of the housing containing the lubrication by the seal assembly 90.

The gear 68 is driven by a drive pinion assembly generally indicated by numeral 140. This assembly includes a shaft portion 142 having a drive pinion 144 integrally formed on the end thereof and having a socketed remote end portion 146 which receives the splined shaft 202 of the drive motor 200. The cover plate 46 is apertured to receive the drive pinion assembly 140 and includes an outer flange 148, which is connected to the relatively thick housing sidewall 150 by means of fasteners 47, and a reduced inner portion 151, which is received within an opening 152 provided in said relatively thick housing sidewall.

Figure 4:
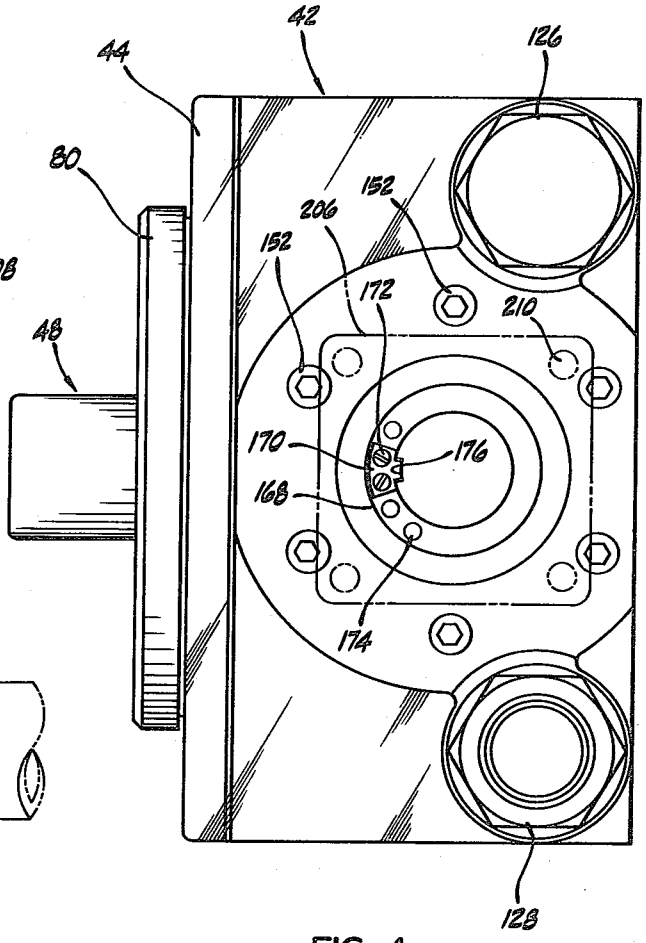
FIG. 4 is an end view thereof.

The pinion assembly 140 is rotatively mounted to the housing 40 by means of a pair of tapered roller bearings 154 and 156 received within grooves 158 and 160 respectively provided on the cover plate 46. The roller bearings 154 and 156 each include shoulders such as those indicated by numerals 162 and 164 respectively which provide the tapered roller bearings with radial and end thrust bearing capability and the pinion shaft 142 is provided with a threaded end portion 160 which receives a compatibly threaded adjustable collar 168. The collar 168 is tightened into thrust bearing relation with bearing 156 and secured in the adjusted position by means of a key 170 as shown in FIG. 4. This key 170 is attached by means of fasteners 172 to the collar 168 which includes a plurality of spaced threaded openings 174 for this purpose, and said key is received within a spline groove 176 provided in the threaded end 166 of the drive shaft 142 to prevent loosening of the collar. A sealing ring 180 is disposed between the cylindrical wall 182 of the socketed end portion of the cover plate 46 and the collar 160.

The longitudinal disposition of the gear assembly 48 is accurately determind by the provision of shims 184 of selected thickness disposed between the cover plate 44 and the housing base 42. In the same manner, the longitudinal disposition of the drive pinion assembly 140 is accurately determined by the provision of shims 186 between the side cover 46 and the housing sidewall 150.

The housing of the motor 200 includes a flange 206 which is attached to the drillhead unit 10, as by fasteners 208 received within threaded openings 210 provided in the drillhead unit cover plate 46. The drillhead unit 10 is attached to the roof bolter carriage 24 as by fasteners 212 received within threaded openings 214 provided in the housing base 42.

As shown in FIG. 3 a breather fitting 220 is provided for the fill plug 218 which is threadedly connected to the cover plate 44 to prevent oil pressure build-up within the drillhead unit 10 due to expansion and contraction of the oil resulting from heat change when the unit is operating. The plug 218 includes a dip stick (not shown) and a drain plug 120 is provided to drain oil from the unit during repair.

In the embodiment described above, the cuttings are removed from the hollow drill bit 28 by vacuum, i.e., negative pressure. However, the structural arrangement of parts of the face seal assembly 90 is such that it can resist positive pressure resulting from reverse fluid flow. Because of this, it is possible to apply positive water pressure to the drillhead unit 10 in lieu of neagtive air pressure. The use of water pressure requires the substitution of the blower B (FIG. 1) by a pump P or similar pressurized water source, the elimination of the dust collector D and the replacement of the vacuum hose 204 by a water pressure hose 230. When water pressure is used the direction of the fluid flow is reversed as compared with flow when air is used as follows. Water is applied to drillhead unit 10 through the pressure hose 230 which is connected to passage 124. This passage is now a supply passage and conveys water under pressure, at about 200 psi, through the cavity 64 and the passages 62 and into the hollow drill bit 28. The water issuing from the drill bit 28 flushes away the cuttings down the side of the drill bit and, in addition, tends to cool the bit and thereby keep it sharp longer. The combination seal 90 can operate under pressure and thereby prevents the ingress of water into the drillhead unit 10. The water pressure system described is particularly useful in conditions where hard roof conditions are experienced.

It is thought that the structural features and functional advantages of this drillhead unit have become fully apparent from the foregoing description of parts, but for completeness of disclosure, the installation and operation of the device will be briefly described with respect to the drillhead unit used in a vacuum system.

The housing base 42 is fitted with the portion of the seal assembly 90 comprising the cylindrical element 100 having the sealing ring 112, the spring 114 and the carbon ring 116 in position. The preassembled gear assembly having the bearings 72 and 74 and stainless stell ring 108 fitted is emplaced coaxially within the housing so that the stainless steel ring 108 is disposed above the resiliently mounted carbon ring 116. The cover plate 44 including the seal 78 is attached to the housing base 42 by means of fasteners 45 with shims 184 and the dust cover 80 is attached to the gear 68 by means of fasteners 82. The drive pinion assembly 140 is preassembled within the housing cover 46 and the cover is attached to the housing sidewall 150 by means of fasteners 47 taking care that the desired shims 186 are in position to insure that the drive pinion 144 accurately engages the gear 68 correctly meshed. The hydraulic motor 200 is connected to the drillhead unit 10 by means of the motor flange 206 and the drillhead unit 10 and the motor 200 are mounted together to the frame 14 of the roof bolter unit 12. The vacuum connection is made to fitting 128 and the other fitting 126 is closed with the plug, the fitting used depending on the proximity to the vacuum supply from the blower B.

In operation, as shown in FIG. 1, the hollow drill bit is fitted into the hexagonal socket 52 and raised upwardly by the carriage into its drilling position. As will be readily understood, the vacuum applid to fitting 128 is applied to the vacuum cavity 64 and removes cuttings from within the hollow drill bit 28 by the negative pressure produced. The sealing system provided by the seal assembly 90, in particular, provides that no negative pressure is applied to the interior of the housing to cause lubricant to be drawn from the bearings.

As will be readily understood, the use of the drillhead unit in a water pressure system simply requirs the substitution of the blower B by a water pressure system, which can be provided by a pump P or by a gravity feed system, the elimination of the dust collector D and the substitution of the vacuum hose 204 with a water hose 230.

I claim as my invention:

1. A drillhead unit for transmitting power from a motor to a hollow drill bit, the unit comprising:

(a) a housing including an inner passage portion, (b) a gear assembly received by the housing and having a longitudinal axis of rotation, said assembly including:

(1) a shaft having an outer bit-receiving end, and an inner end disposed within the housing remote from said outer end and including an annular transverse bearing face disposed inwardly of the shaft outside diameter, and an axial passage extending between said outer and inner ends and connected to the inner passage portion of the housing, and (2) a gear disposed between said inner and outer ends of the shaft and connected to said shaft for rotation therewith, (c) means for mounting the gear assembly to the housing including:

(1) bearing means operatively disposed in coaxial relation between the gear assembly and the housing, and (2) pressure sealing means disposed between the gear assembly and the housing for separating at least the bearing means from the inner passage portion of the housing, said sealing means including:

(1) a coaxial element non-ratatively attached to the housing and including a transverse bearing face spaced from the transverse bearing face of the shaft, and (2) a longitudinal resilient seal mounted between said spaced transverse bearing surfaces within the housing, (d) a pinion assembly received by the housing and having an axis of rotation disposed transversely of the axis of rotation of the gear assembly, said pinion assembly including:

(1) a shaft having an outer end connected to the motor and an inner end remote from said outer end, and (2) a pinion disposed at the inner end of said shaft and connected to said shaft for rotation therewith said pinion being engageable with the gear of said gear assembly in drive relation thereto, (e) means for mounting the pinion assembly to the housing including:

(1) bearing means operatively disposed in coaxial relation between the pinion assembly and the housing.

2. A drillhead unit as defined in claim 1, in which:

(f) the shaft inner end includes a coaxial recess having a cylindrical wall and an annular wall providing the transverse bearing face, and (g) the pressure sealing means coaxial element attached to the housing includes a cylindrical wall, received within the recess cylindrical wall and an annular wall providing the transverse bearing face, and the resilient longitudinal seal includes a combination seal means mounted between said recess annular wall and said coaxial element annular wall and between said recess cylindrical wall and said coaxial element cylindrical wall.

3. A drillhead unit as defined in claim 1, in which:

(f) the housing inner passage portion includes a pair of transversely extending passages providing optional connection to a pressure source.

4. A drillhead unit for transmitting power from a motor to a hollow drill bit, the unit comprising:

(a) a housing including an inner passage portion, (b) a gear assembly received by the housing and having a longitudinal axis of rotation, said assembly including:

(1) a shaft having an outer bit-receiving end, and an inner end remote from said outer end, and an axial passage extending between said outer and inner ends and connected to the inner passage portion of the housing, and (2) a gear disposed between said inner and outer ends of the shaft and connected to said shaft for rotation therewith, (c) means for mounting the gear assembly to the housing including:

(1) bearing means operatively disposed in coaxial relation between the gear assembly and the housing, and (2) pressure sealing means disposed between the gear assembly and the housing for separating at least the bearing means from the inner passage portion of the housing, (d) a pinion assembly received by the housing and having an axis of rotation disposed transversely of the axis of rotation of the gear assembly, said pinion assembly including:

(1) a shaft having an outer end connected to the motor and an inner end remote from said outer end, and (2) a pinion disposed at the inner end of said shaft and connected to said shaft for rotation therewith said pinion being engageable with the gear of said gear assembly in drive relation thereto, (e) means for mounting the pinion assembly to the housing including:

(1) bearing means operatively disposed in coaxial relation between the pinion assembly and the housing, (f) the gear assembly shaft inner end including a coaxial annular recess having a transverse bearing face, and opposed cylindrical walls, and (g) the pressure sealing means including:

(1) a coaxial cylindrical element fixedly attached to the housing and having a transverse bearing face spaced from said recess transverse bearing face, (2) an annular ring having opposed bearing faces, one of said faces being operatively engageable in bearing relation with said recess transverse bearing face, (3) a spring coaxially mounted to said cylindrical element and being operatively engageable with said cylindrical element transverse bearing face, (4) an annular seal disposed in sealed relation with the cylindrical element and having opposed bearing faces, one of said faces being operatively engageable in bearing relation with said spring and being urged away from said cylindrical element transverse bearing face, (5) a ring of dissimilar material to the annular ring disposed between the annular seal and the other face of the annular ring, in operatively engageable sliding relation to said other face, and (6) O-ring means disposed between said annular ring and one of said cylindrical recess walls, and between said cylindrical element and the other of said cylindrical recess walls.

5. A drillhead unit for transmitting power from a motor to a hollow drill bit, the unit comprising:

(a) a housing including an inner passage portion, (b) a gear assembly received by the housing and having a longitudinal axis of rotation, said assembly including:

(1) a shaft having an outer bit-receiving end, and an inner end disposed within the housing remote from said outer end and including an annular transverse bearing face, and an axial passage extending between said outer and inner ends and connected to the inner passage portion of the housing, and (2) a gear disposed between said inner and outer ends of the shaft and connected to said shaft for rotation therewith, (c) means for mounting the gear assembly to the housing including:

(1) bearing means operatively disposed in coaxial relation between the gear assembly and the housing, and (1) pressure sealing means disposed between the gear assembly and the housing for separating at least the bearing means from the inner passage portion of the housing, said sealing means including:

(1) a coaxial element non-rotatively attached to the housing and including a transverse bearing face spaced from the transverse bearing face of the shaft, and (2) a longitudinal resilient seal mounted between said spaced transverse bearing surfaces within the housing, (d) a pinion assembly received by the housing and having an axis of rotation disposed transversely of the axis of rotation of the gear assembly, said pinion assembly including:

(1) a shaft having an outer end connected to the motor and an inner end remote from said outer end, and (2) a pinion disposed at the inner end of said shaft and connected to said shaft for rotation therewith said pinion being engageable with the gear of said gear assembly in drive relation thereto, (e) means for mounting the pinion assembly to the housing including:

(1) bearing means operatively disposed in coaxial relation between the pinion assembly and the housing, and (f) the bearing means of the mounting means for the pinion assembly including spaced inner and outer bearings having radial and thrust bearing capability, and (g) the housing includes a base and a removable cover for the pinion assembly, said cover having an outer portion and a reduced diameter inner portion received within the base, and said cover carrying the spaced bearings of the pinion assembly to permit the pinion assembly to be removed from the housing as a unit and shim means between the cover outer portion and the base provide axial adjustment of the cover relative to the base to determine the location of the pinion relative to the axis of the gear and ensure accurate engagement between said pinion and gear.

6. A drillhead unit as defined in claim 5, in which:

(h) the pinion assembly shaft includes a threaded end, (i) the mounting means for said assembly includes a collar threadedly received by said threaded end, and (j) said collar cooperates with said bearing means to hold said pinion assembly to said cover to facilitate removal thereof from said housing as a unit.

7. A drillhead unit as defined in claim 6, in which:

(k) the pinion assembly shaft is includes a motor shaft receiving means and sealing means is provided between said collar and said removable cover.

* * * * *